United States Patent [19]

Sood et al.

[11] 4,224,059

[45] Sep. 23, 1980

[54] CARBOTHERMIC PRODUCTION OF ALUMINIUM

[75] Inventors: Raman R. Sood; Meine Vandermeulen, both of Kingston, Canada

[73] Assignee: Alcan Research and Development Limited, Montreal, Canada

[21] Appl. No.: 64,583

[22] Filed: Aug. 7, 1979

[51] Int. Cl.[2] ..... C22B 21/02

[52] U.S. Cl. ..... 75/68 A; 75/10 R; 75/25

[58] Field of Search ..... 75/25, 10 R, 68 R, 68 A

[56] References Cited

U.S. PATENT DOCUMENTS 4,099,959 7/1978 Dewing et al. ..... 75/68 A

*Primary Examiner*—M. J. Andrews

*Attorney, Agent, or Firm*—Cooper, Dunham, Clark, Griffin & Moran

[57] ABSTRACT

In a process for production of aluminium metal described in U.S. Pat. No. 4,099,959 carbon monoxide gas is evolved at very high temperature through reaction of aluminium carbide and alumina in a high temperature zone of the system. This gas is cooled by contact with a molten alumina slag at a lower temperature to cause back reaction of contained aluminium suboxide and Al vapor and consequent heat transfer to the contacted molten alumina slag.

A body of molten alumina slag is maintained in a pretreatment zone, to which carbon and alumina feed are introduced and the carbon monoxide gas is led into the pretreatment zone. Excess slag, resulting from such introduction of feed and from gaseous back reaction, spills over into a low temperature zone of the system to augment the circulating slag stream.

6 Claims, 1 Drawing Figure

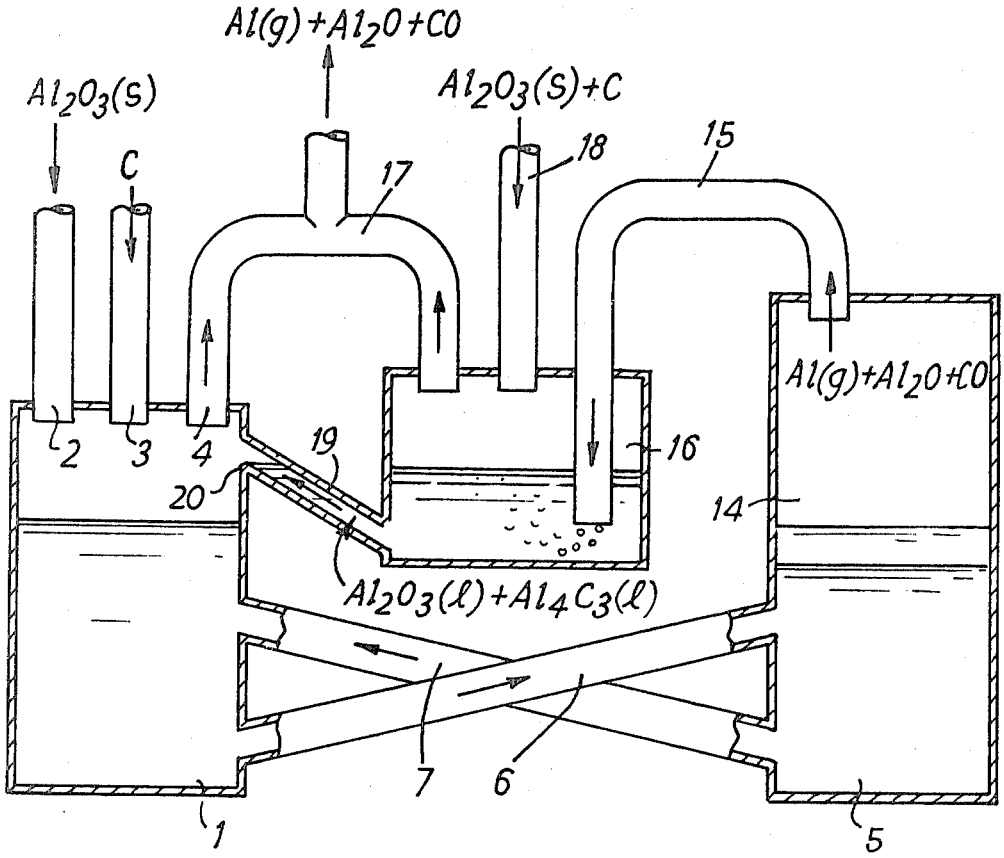
Al(g)+Al2O+CO
Al2O3(S)
C
Al2O3(S)+C
18
15
17
Al(g)+Al2O+CO
2
3
4
19
16
20
14
Al2O3(ℓ)+Al4C3(ℓ)
7
6
1
5

CARBOTHERMIC PRODUCTION OF ALUMINIUM

The present invention relates to the carbothermic reduction of alumina to produce aluminium metal.

In U.S. Pat. No. 4,099,959 a process for the production of aluminium by carbothermic reduction of alumina has been described. In that process a molten alumina slag, containing dissolved aluminium carbide is circulated between a zone of relatively low temperature, in which carbon feed material is added to the slag to react with the alumina to augment the aluminium carbide content of the slag, and a zone of relatively high temperature in which aluminium carbide reacts with alumina to release aluminium metal which is collected and separated from the slag, the aluminium carbide content of the slag being simultaneously reduced. Various improvements and modifications in the process of U.S. Pat. No. 4,099,959 are described in co-pending Patent Applications Ser. Nos. 962,622, 962,652 and 962,630.

The reaction in the low temperature zone may be represented as $$2Al_2O_3+9C \rightarrow Al_4C_3 \text{ (in solution)}+6CO$$

whereas the reaction in the high temperature zone may be represented as $$Al_4C_3 \text{ (in solution)}+Al_2O_3 \rightarrow 6Al+3CO$$

These reactions are both highly endothermic and proceed at temperatures within the ranges of about 1950°–2050° C. and 2050° C.–2150° C. respectively.

The large volumes of gas released in the low temperature zone and in the high temperature zone carry substantial quantities of fume (both Al metal vapour and aluminium suboxide $Al_2O$). The amount of fume carried by the evolved CO is considerably greater in the gas evolved in the high temperature zone than in the gas from the low temperature zone because of the higher temperature. This is true whenever the carbothermic reduction of alumina is carried out in a system where the two above-mentioned reactions proceed in different zones of the system.

In U.S. Pat. No. 4,099,959 an arrangement is described by which fume components can be removed from the evolved gas by passing the gas through the carbon feed material prior to introduction of the feed material to the low temperature zone.

It is an objective of the present invention to provide a simplified and more efficient procedure for the removal of fume components from the evolved gas. The method of the present invention is preferably used to complement any external system for fume removal and heat recovery from the evolved gas and is particularly intended to achieve cooling of and partial fume removal from the gas evolved in the high temperature zone by cooling it down to a temperature similar to that of the gas evolved in the low temperature zone.

In its broadest aspects the present invention comprises passing the gas evolved in a high temperature zone through a body of molten slag maintained in a pretreatment zone at a temperature below the temperature of the high temperature zone, for example at 100° C. below the temperature of the high temperature zone and thus approximating to the low temperature zone temperature.

The molten slag in the pretreatment zone is supplemented by fresh cold or relatively cool solid carbon and alumina feed material. The slag receives heat from the sensible heat of the gas and from the exothermic back reaction of Al vapour and $Al_2O$ with CO and with the feed materials, so that fresh molten slag is continuously formed in the pretreatment zone. This is allowed to spill over into the lower temperature zone of the carbothermic reduction system. In the pretreatment zone the fresh feed material is heated to approximately the low temperature zone temperature. The CO gas with reduced Al vapour and $Al_2O$ content, after leaving the pretreatment zone, is preferably mixed with the gas and fumes evolved in the low temperature zone and the gas stream is then forwarded to further gas treatment and heat recovery stages.

It will be understood that where the method of the present invention is practised in a system in which there are a series of alternate low temperature zones and high temperature zones, the gas evolved from two or more high temperature zones may be passed to a single pretreatment zone, from which slag spills over to an equal number of low temperature zones. However, it is always preferred to provide one pretreatment zone in association with each high temperature and associated low temperature zone, which in a multi zone system may either precede or succeed the high temperature zone.

The method of the present invention requires that the gas space in the high temperature zone be maintained at a higher pressure than in the pretreatment zone in order to drive the gas from the high temperature zone through the molten slag in the pretreatment zone. A sufficient driving pressure in the high temperature zone may exist when the pressure in the high temperature zone exceeds the pressure in the pretreatment zone and the low temperature zone by about 0.01–0.03 atmospheres.

Since the gas from the high temperature zone is being brought substantially into chemical and thermal equilibrium with the slag in the pretreatment zone, its temperature and fume content will have been reduced to values typical of that zone.

In the accompanying drawing

FIG. 1 shows diagrammatically a side view of one system for carrying out the present invention.

The vessel 1 constitutes the low temperature zone of the carbothermic reduction system and includes separate supply conduits 2 and 3 for the introduction of carbon and alumina feed materials respectively. The vessel is provided with a gas outlet conduit 4 for release of gas evolved in the low temperature zone of the system. While alumina is preferably added to the circulating slag at the vessel 1, this is for convenience only and it may be introduced without difficulty at other locations in the system.

The low temperature zone vessel 1 is connected with high temperature zone vessel 5 by a forward flow conduit 6 for the slag in which a major part of the second zone reaction occurs. As already disclosed in U.S. Pat. No. 4,099,959, evolution of gas in this upwardly sloping flow conduit 6 promotes circulation of slag in the system, the slag returning from the vessel 5 to the vessel 1 through an upwardly directed return conduit 7. The heat input to the system is achieved by means of electrical resistance heating by passage of current between electrodes (not shown) in the vessels 1 and 5 respectively.

In the low temperature vessel 1 the reaction between the slag returned from the vessel 5 and fresh carbon takes place essentially in the region of a supernatant layer of carbon particles supplied via the supply conduit 3.

In accordance with the present invention the second vessel 5 is essentially enclosed to provide a gas space 14, which in operation will be at superatmospheric pressure. A gas flow conduit 15 leads from the space 14 into a pretreatment vessel 16. The pretreatment vessel 16 is provided with a gas outlet conduit 17, which connects with the gas outlet conduit 4 from the vessel 1, and a material inlet conduit 18, through which $Al_2O_3$ and C are supplied to the vessel 16. Alternatively separate conduits may be utilized for the supply of alumina and carbon to vessel 16 to allow greater ease of control of the relative proportions of these materials. As fresh material is introduced through conduit 18 an equivalent amount of slag spills out from vessel 16 via an upwardly inclined conduit 19 and over a weir 20 into vessel 1. The lower end of the gas conduit 15 is arranged to be beneath the level of the weir 20 so as to ensure delivery of gas beneath the level of the slag in vessel 16 and thus ensure intimate contact between the gas and the slag in the pretreatment vessel 16. In operation the vertical distance between the weir 20 and the end of the gas conduit 15 determines the pressure difference between the atmosphere in the vessel 5 and in the vessels 1 and 16. The slag in conduit 19 acts as a gas seal to prevent passage of gas from vessel 5 to vessel 1.

It is found that in operating the system in such a way as to maintain the temperature of the slag in the pretreatment zone at approximately the same temperature as in the low temperature zone the CO content of the gas from the high temperature vessel 5 becomes somewhat depleted, and the $Al_2O_3$ spilling over in the slag increases in relation to the $Al_2O_3$ input to the treatment chamber. The Al vapour and $Al_2O$ content of the gas may be reduced to about 20% of its initial value. The Al vapour and $Al_2O$ taken up from the gas stream are converted to $Al_4C_3$ and $Al_2O_3$ by reaction with gaseous CO and the solid carbon feed.

Control of the temperature of the slag in the pretreatment zone may be effected by change in the rate of feed of carbon and alumina. Increase in the feed rate of alumina will lead to a decrease in the slag temperature while carbon is required to be introduced in an amount at least sufficient to promote maximum recovery of gaseous aluminium values from the carbon monoxide stream as aluminium carbide dissolved in the slag which is subsequently recirculated to the low temperature zone. The temperature in the pretreatment zone may also be controlled by an auxiliary heating device.

We claim:

1. In a process for the production of aluminium metal in which a circulating stream of molten alumina slag containing combined carbon is passed through one or more zones of relatively low temperature at which carbon feed is added for reaction with alumina to form aluminium carbide with evolution of carbon monoxide gas and through one or more zones maintained at a higher temperature such that aluminium carbide reacts with alumina for production of aluminium metal with evolution of further carbon monoxide gas having a content of aluminium suboxide and aluminium vapour higher than that of carbon monoxide evolved in the low temperature zone or zones the improvement which consists in leading a stream of carbon monoxide from a high temperature zone to a pretreatment zone, maintaining a body of molten alumina-containing slag in said pretreatment zone at a temperature below the temperature in said high temperature zone or zones, feeding carbon and alumina to said pretreatment zone, bringing said stream of carbon monoxide into intimate contact with said slag in said pretreatment zone for reacting said slag with a part of the aluminium suboxide and aluminium vapour content of said carbon monoxide stream, discharging from said pretreatment zone to a low temperature zone a stream of excess slag resulting from said reaction and discharging from said pretreatment zone a stream of cooled carbon monoxide having a depleted content of aluminium suboxide and aluminium vapour.

2. A process according to claim 1 in which said stream of carbon monoxide from a high temperature zone is bubbled through the slag in said pretreatment zone.

3. A process according to claim 1 in which the stream of excess slag is led out of the pretreatment zone via an upwardly directed column of said slag providing a gas seal between said pretreatment zone and said low temperature zone.

4. A process according to claim 1 in which a separate pretreatment zone is associated with each low temperature zone in said process.

5. A process according to claim 1 in which the temperature of the slag in the pretreatment zone is controlled by variation of the rate of addition of feed material thereto.

6. A process according to claim 1 in which control of the temperature of the slag in the pretreatment zone may be achieved by auxiliary means.

* * * * *